US011315509B2

(12) United States Patent
Qiao et al.

(10) Patent No.: US 11,315,509 B2
(45) Date of Patent: Apr. 26, 2022

(54) DRIVING METHOD FOR LIQUID CRYSTAL DISPLAY DEVICE

(71) Applicant: INFOVISION OPTOELECTRONICS (KUNSHAN) CO., LTD., Suzhou (CN)

(72) Inventors: Yanbing Qiao, Suzhou (CN); Xiaoneng Yan, Suzhou (CN); Te-Chen Chung, Suzhou (CN); Chia-Te Liao, Suzhou (CN)

(73) Assignee: INFOVISION OPTOELECTRONICS (KUNSHAN) CO., LTD., Suzhou (CN)

( * ) Notice: Subject to any disclaimer, the term of this patent is extended or adjusted under 35 U.S.C. 154(b) by 0 days.

(21) Appl. No.: 17/277,729

(22) PCT Filed: Nov. 5, 2018

(86) PCT No.: PCT/CN2018/114023

§ 371 (c)(1),
(2) Date: Mar. 18, 2021

(87) PCT Pub. No.: WO2020/093216

PCT Pub. Date: May 14, 2020

(65) Prior Publication Data

US 2021/0350757 A1 Nov. 11, 2021

(51) Int. Cl.
*G09G 3/36* (2006.01)

(52) U.S. Cl.
CPC ..... *G09G 3/3648* (2013.01); *G09G 3/3614* (2013.01); *G09G 2320/028* (2013.01);
(Continued)

(58) Field of Classification Search
CPC ..... G09G 3/3648; G09G 3/3614; G09G 2320/0233; G09G 2320/028; G09G 2320/0673; G09G 2320/068
See application file for complete search history.

(56) References Cited

U.S. PATENT DOCUMENTS 7,084,845 B2 * 8/2006 Hong ..... G09G 3/3648 345/87
7,936,325 B2 * 5/2011 Miyata ..... G09G 3/3648 345/89

(Continued)

FOREIGN PATENT DOCUMENTS

CN 103091883 A 5/2013
CN 106448601 A 2/2017

(Continued)

*Primary Examiner* — Michael J Jansen, II
(74) *Attorney, Agent, or Firm* — Cheng-Ju Chiang

(57) ABSTRACT

A driving method for a liquid crystal display device is provided. The liquid crystal display device has a wide viewing angle mode and a narrow viewing angle mode. The driving method includes: in the wide viewing angle mode, all the frames of the liquid crystal display device have the same display brightness; in the narrow viewing angle mode, the odd frames and the even frames of the liquid crystal display device have different display brightness. In the narrow viewing angle mode of the liquid crystal display device, by using an alternate driving method of bright frames and dark frames, the mura degree is significantly reduced, and the smoothness of dynamic picture display is improved, thereby improving the use experience of users.

12 Claims, 8 Drawing Sheets

(52) U.S. Cl.
CPC ..... *G09G 2320/0233* (2013.01); *G09G 2320/068* (2013.01); *G09G 2320/0673* (2013.01)

(56) References Cited

U.S. PATENT DOCUMENTS

| | | | | |
|---|---|---|---|---|
| 8,094,143 | B2 * | 1/2012 | Kamada | G09G 3/3607 345/204 |
| 8,189,154 | B2 * | 5/2012 | Nakagawa | G09G 3/3648 349/129 |
| 8,350,796 | B2 * | 1/2013 | Tomizawa | G09G 3/3648 345/96 |
| 8,638,282 | B2 * | 1/2014 | Shimoshikiryoh | G09G 3/3614 345/89 |
| 8,754,837 | B2 * | 6/2014 | Yamato | G09G 3/3648 345/96 |
| 9,111,505 | B2 * | 8/2015 | Hirata | G09G 3/3607 |
| 9,142,190 | B2 * | 9/2015 | Wu | G09G 5/10 |
| 9,711,080 | B2 * | 7/2017 | Kang | G09G 3/3225 |
| 10,649,283 | B2 * | 5/2020 | Chung | G02F 1/13306 |
| 2003/0006952 | A1 * | 1/2003 | Hong | G09G 3/3648 345/89 |
| 2007/0152930 | A1 | 7/2007 | Jin et al. | |
| 2008/0088559 | A1 * | 4/2008 | Lai | G09G 3/3648 345/89 |
| 2008/0143755 | A1 * | 6/2008 | Sung | G09G 3/3611 345/690 |
| 2008/0180377 | A1 | 7/2008 | Meng | |
| 2008/0198117 | A1 * | 8/2008 | Kumakura | G09G 3/3648 345/89 |
| 2009/0121994 | A1 * | 5/2009 | Miyata | G09G 3/3648 345/89 |
| 2009/0167737 | A1 * | 7/2009 | Chen | H04N 5/64 345/207 |
| 2009/0195487 | A1 * | 8/2009 | Shimoshikiryoh | G09G 3/3614 345/89 |
| 2010/0090938 | A1 * | 4/2010 | Kamada | G09G 3/3648 345/92 |
| 2010/0091033 | A1 * | 4/2010 | Itoyama | G09G 3/2092 345/600 |
| 2010/0103206 | A1 * | 4/2010 | Kamada | G09G 3/3607 345/690 |
| 2010/0149227 | A1 * | 6/2010 | Tomizawa | G09G 3/3648 345/694 |
| 2012/0105514 | A1 * | 5/2012 | Yamato | G09G 3/3648 345/691 |
| 2012/0133682 | A1 * | 5/2012 | Kawano | G09G 3/3233 345/690 |
| 2013/0127839 | A1 * | 5/2013 | Ki | H04N 13/207 345/419 |
| 2014/0146066 | A1 * | 5/2014 | Kang | G09G 3/3225 345/545 |
| 2015/0042693 | A1 * | 2/2015 | Hirata | G09G 3/3614 345/690 |
| 2017/0018254 | A1 * | 1/2017 | Chang | G09G 5/02 |
| 2017/0162143 | A1 | 6/2017 | Hao | |
| 2019/0278117 | A1 * | 9/2019 | Chung | G02F 1/13 |
| 2021/0020115 | A1 * | 1/2021 | Lee | G02B 6/0073 |
| 2021/0223584 | A1 * | 7/2021 | Fan | G02F 1/1343 |
| 2021/0286206 | A1 * | 9/2021 | Chung | G02F 1/13706 |

FOREIGN PATENT DOCUMENTS

| | | | |
|---|---|---|---|
| CN | 107466376 | A | 12/2017 |
| CN | 107820581 | A | 3/2018 |
| CN | 107991800 | A | 5/2018 |
| CN | 107995958 | A | 5/2018 |
| CN | 108257576 | A | 7/2018 |
| JP | 3999081 | B2 | 10/2007 |
| JP | 2007-298994 | A | 11/2007 |
| JP | 2010-243520 | A | 10/2010 |
| KR | 2003-0005801 | A | 1/2003 |
| KR | 10-2017-0006039 | A | 1/2017 |
| TW | I488168 | B | 6/2015 |
| TW | I589957 | B | 7/2017 |
| TW | 201805705 | A | 2/2018 |

* cited by examiner

DRIVING METHOD FOR LIQUID CRYSTAL DISPLAY DEVICE

CROSS REFERENCE TO RELATED APPLICATIONS

This application is a 35 U.S.C. § 371 National Phase conversion of International (PCT) Patent Application No. PCT/CN2018/114023, filed on Nov. 5, 2018. The contents of the above-identified application are incorporated herein by reference. The PCT International Patent Application was filed and published in Chinese.

TECHNICAL FIELD

The present invention relates to the field of liquid crystal display, and more particularly, to a driving method for a liquid crystal display device.

BACKGROUND

Liquid crystal display (LCD) device has the advantages of being good in image quality, small in size, light in weight, low in driving voltage, low in power consumption, free of radiation, and relatively low in manufacturing cost, and occupies domination in the field of flat panel display.

Liquid crystal display devices are gradually developing towards a wide viewing angle, for example, an in-plane switching mode (IPS) or fringe field switching mode (FFS) liquid crystal display device can achieve a wide viewing angle. However, people are currently paying more and more attention to protecting their privacy, and there are many things that they don't like to share with others. In public, people always hope that the content is kept secret when they are looking at their mobile phones or browsing computers. Therefore, the display device with a single viewing angle mode can no longer meet the needs of the user. In addition to the need for a wide viewing angle, it is also desirable to be able to switch the display device to a narrow viewing angle mode when anti-peeping is required.

Currently, there is a way to use a viewing angle control electrode on the color filter substrate (CF) to apply a vertical electric field to liquid crystal molecules to achieve switching between wide and narrow viewing angles. Referring to FIGS. 1 and 2, the liquid crystal display device includes an upper substrate 11, a lower substrate 12 and a liquid crystal layer 13 disposed between the upper substrate 11 and the lower substrate 12. The upper substrate 11 is provided with a viewing angle control electrode 111. As shown in FIG. 1, during wide viewing angle display, the viewing angle control electrode 111 of the upper substrate 11 is not applied with a voltage, so that the liquid crystal display device realizes wide viewing angle display. As shown in FIG. 2, when a narrow viewing angle display is required, the viewing angle control electrode 111 of the upper substrate 11 is applied with a voltage, the liquid crystal molecules in the liquid crystal layer 13 will tilt due to the vertical electric field E, and the liquid crystal display device will leak light from large observation angles, so that a narrow viewing angle is finally achieved.

That is, in the narrow viewing angle mode, by applying a bias voltage on the viewing angle control electrode of the CF side, the liquid crystal molecules are tilted to form light leakage from large observation angles, so as to control the viewing angle of the liquid crystal display device and realize the anti-peeping effect. However, in the narrow viewing angle mode, there is a problem of uneven display (i.e., mura) at large observation angles, which affects the user experience.

SUMMARY

An object of the present invention is to provide a driving method for a liquid crystal display device, which can avoid the problem of uneven display at large observation angles of the liquid crystal display device in a narrow viewing angle mode, to improve the user experience.

An embodiment of the present invention provides a driving method for a liquid crystal display device having a wide viewing angle mode and a narrow viewing angle mode. The driving method includes:

in the wide viewing angle mode, all frames of the liquid crystal display device having the same display brightness;

in the narrow viewing angle mode, the odd frames and the even frames of the liquid crystal display device having different display brightness.

Further, in the narrow viewing angle mode, the display brightness of the odd frames of the liquid crystal display device is higher than that of the even frames, or the display brightness of the even frames of the liquid crystal display device is higher than that of the odd frames.

Further, in the narrow viewing angle mode, the liquid crystal display device adopts a way of varying the driving voltages to realize that the odd frames and the even frames have different display brightness.

Further, in the narrow viewing angle mode, the liquid crystal display device is driven with two sets of gamma voltages of different voltage values, one set of gamma voltages is used when the odd frames are displayed, and the other set of gamma voltages is used when the even frames are displayed.

Further, in the narrow viewing angle mode, the liquid crystal display device adopts a way of processing the image data to achieve that the odd frames and the even frames have different display brightness.

Further, the liquid crystal display device includes an image processor, the image processor is used to add or subtract the image data, and the processed image data is then transmitted to the liquid crystal display device for display.

Further, the liquid crystal display device includes a first substrate, a second substrate disposed opposite to the first substrate, and a liquid crystal layer located between the first substrate and the second substrate, an auxiliary electrode is provided on the first substrate, a common electrode and pixel electrodes are provided on the second substrate; wherein:

when a DC reference voltage is applied to the common electrode, and the voltage applied to the auxiliary electrode is same or similar as the common electrode, the voltage difference between the auxiliary electrode and the common electrode is less than a preset value, and the liquid crystal display device is in the wide viewing angle mode;

when a DC reference voltage is applied to the common electrode, and an AC voltage fluctuated up and down around the DC reference voltage is applied to the auxiliary electrode, the voltage difference between the auxiliary electrode and the common electrode is greater than a preset value, and the liquid crystal display device is in the narrow viewing angle mode.

Further, the liquid crystal display device includes a first substrate, a second substrate disposed opposite to the first substrate, and a liquid crystal layer located between the first substrate and the second substrate, an auxiliary electrode is provided on the first substrate, a common electrode and pixel electrodes are provided on the second substrate; wherein:

when a DC reference voltage is applied to the auxiliary electrode, and the voltage applied to the common electrode is same or similar as the auxiliary electrode, the voltage difference between the common electrode and the auxiliary electrode is less than a preset value, and the liquid crystal display device is in the wide viewing angle mode;

when a DC reference voltage is applied to the auxiliary electrode, and an AC voltage fluctuated up and down around the DC reference voltage is applied to the common electrode, the voltage difference between the common electrode and the auxiliary electrode is greater than a preset value, and the liquid crystal display device is in the narrow viewing angle mode.

Further, the AC voltage changes its polarity once every two frames, and the period of the AC voltage is four times the display time of each frame of the liquid crystal display device.

Further, the AC voltage changes its polarity twice per frame, and the period of the AC voltage is equal to the display time of each frame of the liquid crystal display device.

Further, the common electrode and the pixel electrodes are located on different layers and are separated by an insulating layer. The pixel electrodes are located above the common electrode. Each pixel electrode has a comb-shaped structure, and the common electrode is a whole surface structure.

Further, in the narrow viewing angle mode, an image refresh rate of the liquid crystal display device is 120 frames per second.

Further, the liquid crystal display device is provided with a viewing angle switching button configured for users to switch different viewing angle modes of the liquid crystal display device.

Further, the liquid crystal display device is provided with a detection sensor configured for detecting whether there is a person near the liquid crystal display device, and the liquid crystal display device is controlled to switch between different viewing angle modes automatically according to the detection result.

Further, the liquid crystal display device detects the usage scenarios of the users, and the liquid crystal display device is controlled to switch between different viewing angle modes automatically according to the detection result.

The driving method of the liquid crystal display device provided by embodiments of the present invention, in the narrow viewing angle mode, by using the driving method of bright frames and dark frames alternating with each other, the image quality in the bias mode is better than that of the original, the mura degree is significantly slight, to improve the mura problem of the existing liquid crystal display device at large observation angles in the bias mode, thereby improving the smoothness of dynamic picture display and improving the user experience.

DETAILED DESCRIPTION OF PREFERRED EMBODIMENTS

In order to make the objectives, technical solutions, and advantages of the present invention clear, the embodiments of the present invention will be further described below with reference to the accompanying drawings.

Figure 1:
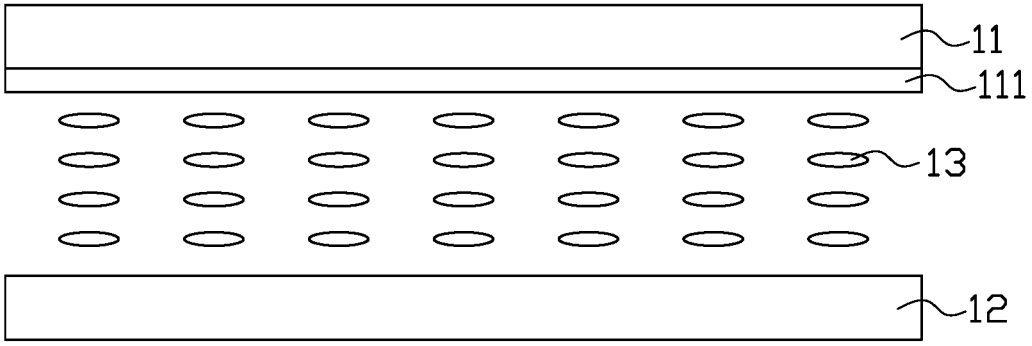
FIG. 1 (Prior Art)
FIG. 1 is a schematic diagram showing a cross-sectional structure of a conventional liquid crystal display device in a wide viewing angle mode.
Figure 2:
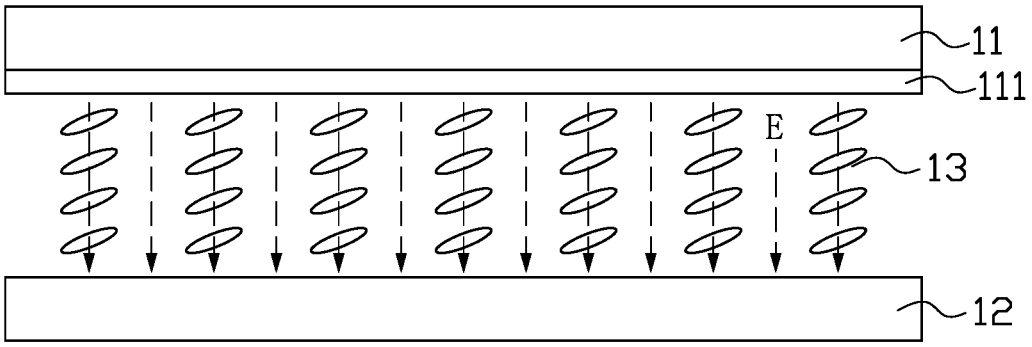
FIG. 2 (Prior Art)
FIG. 2 is a schematic diagram showing a cross-sectional structure of the liquid crystal display device of FIG. 1 in a narrow viewing angle mode.
Figure 3:
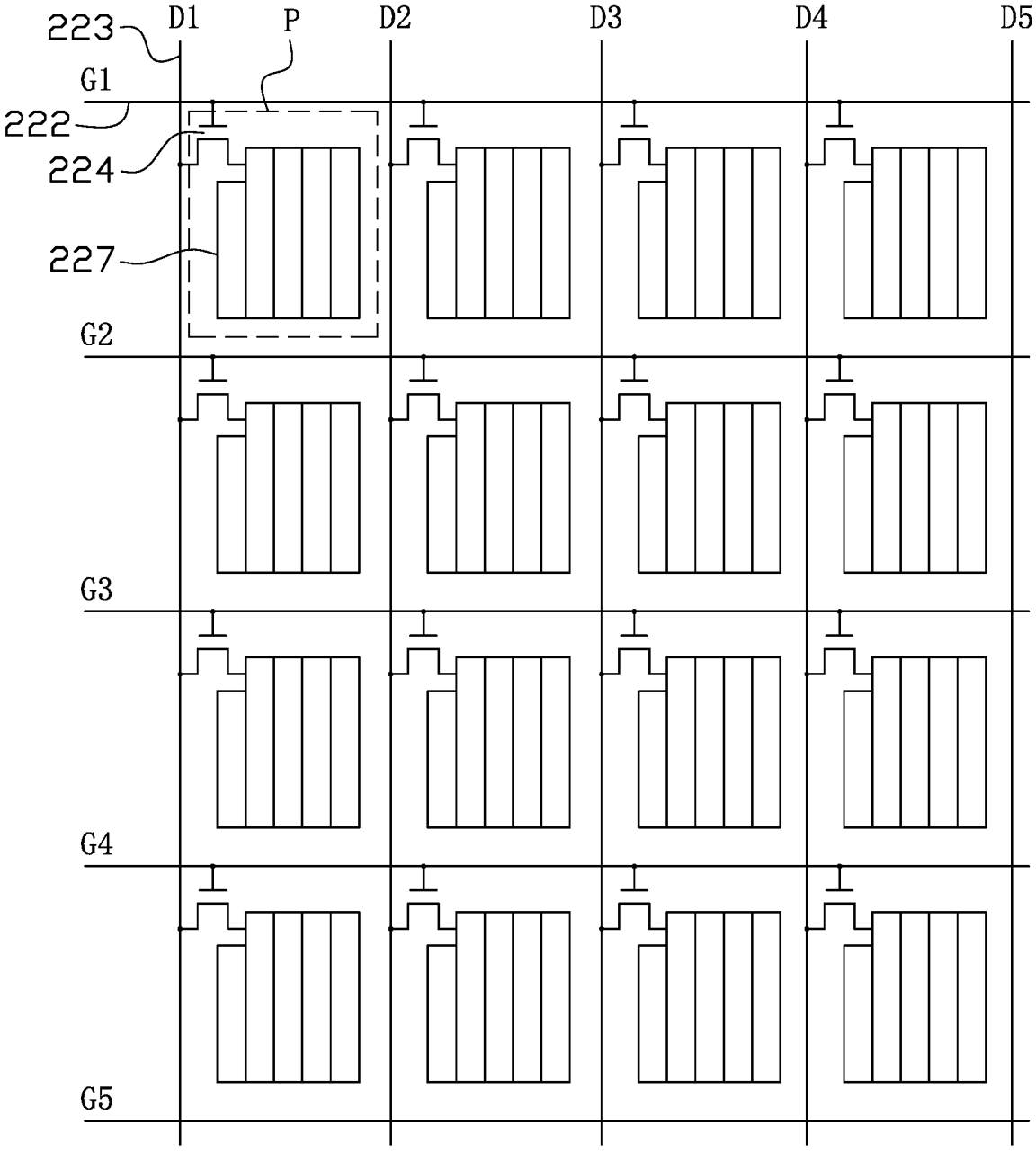
FIG. 3 is a schematic circuit diagram of a liquid crystal display device in an embodiment of the present invention.
Figure 4:
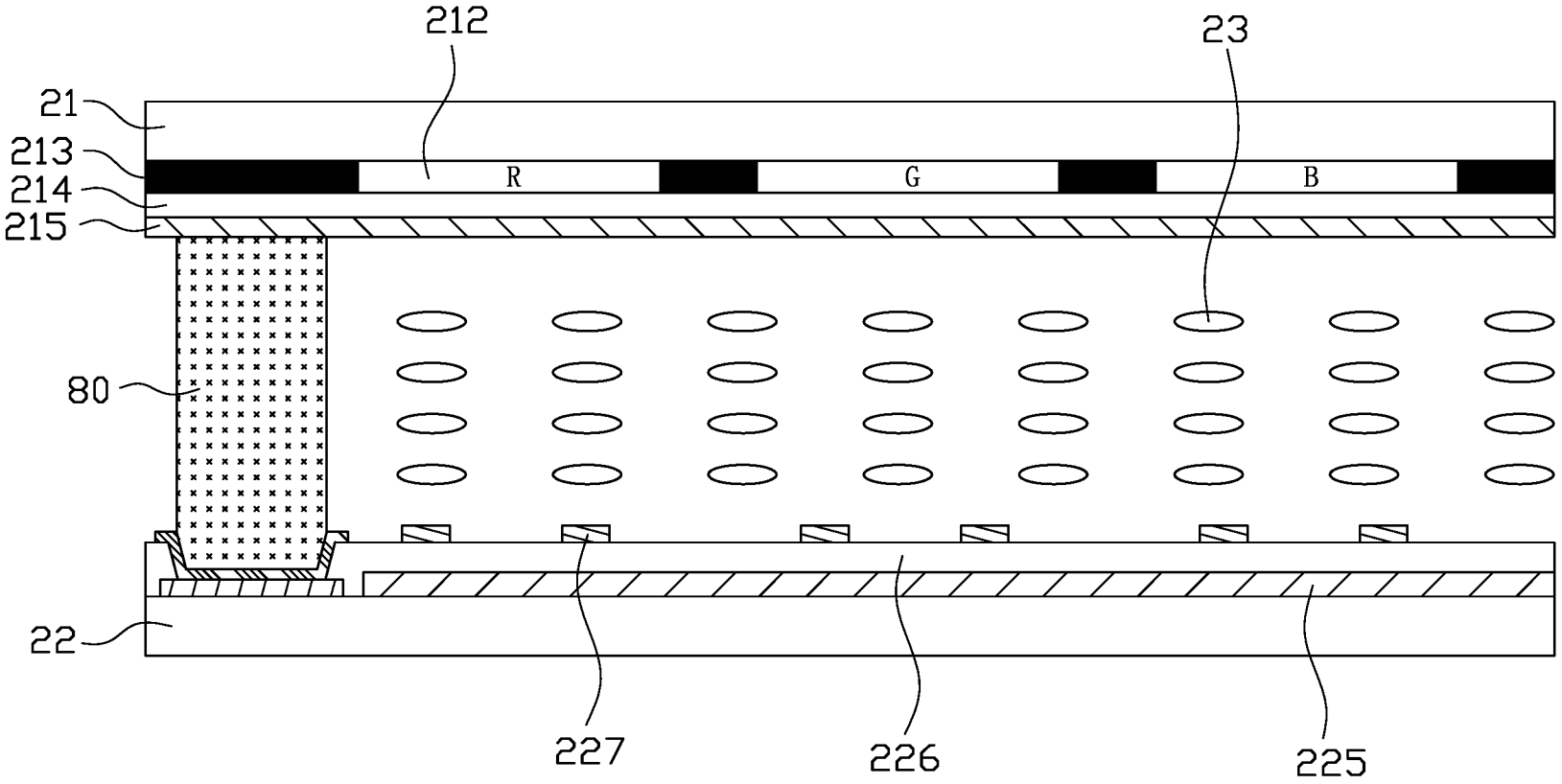
FIG. 4 is a schematic diagram showing a cross-sectional structure of the liquid crystal display device of FIG. 3 in a wide viewing angle mode.
Figure 5:
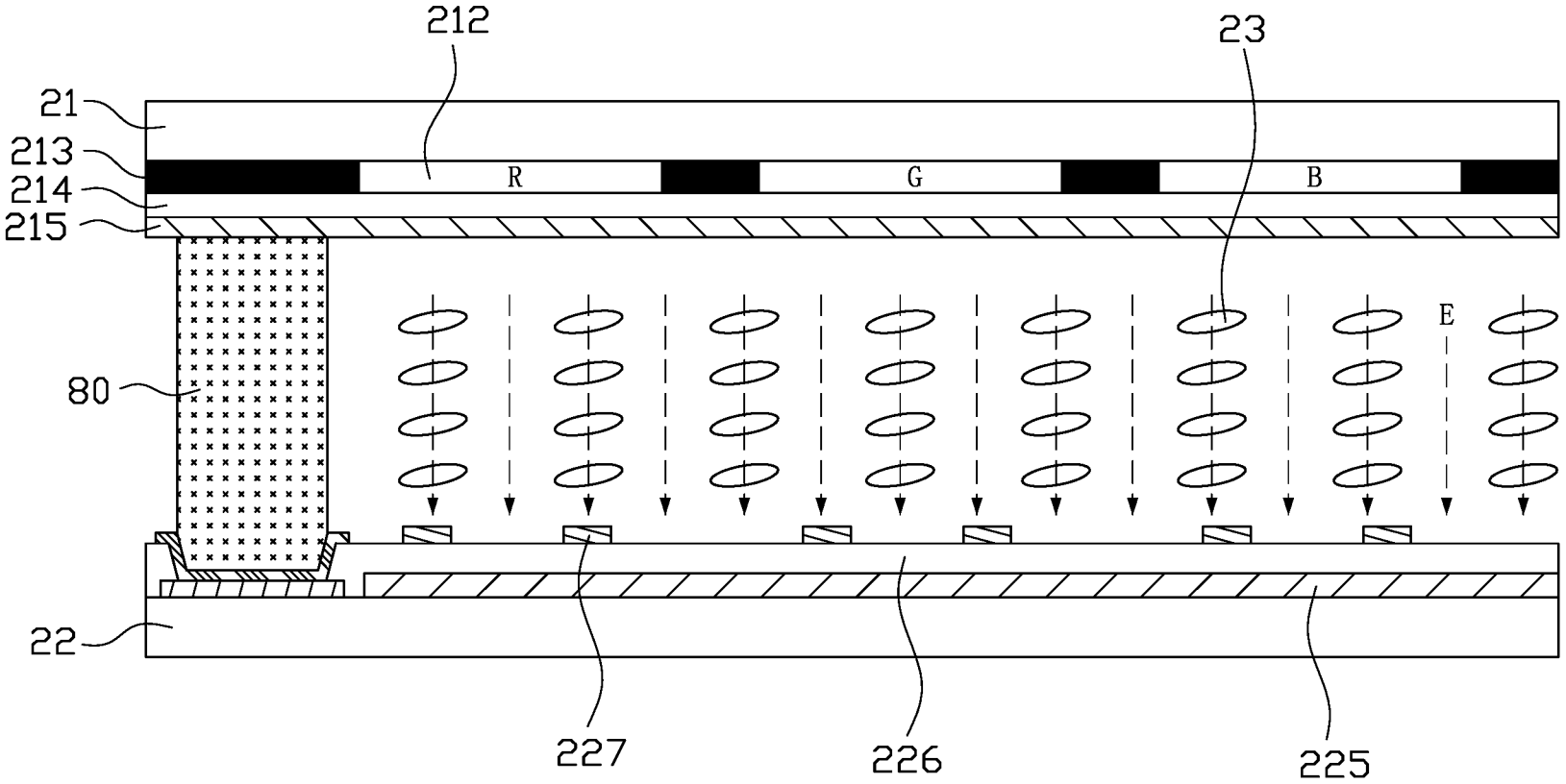
FIG. 5 is a schematic diagram showing a cross-sectional structure of the liquid crystal display device of FIG. 3 in a narrow viewing angle mode.

Referring to FIGS. 3 to 5, an embodiment of the present invention provides a liquid crystal display device that can switch between a wide viewing angle (WVA) mode and a narrow viewing angle (NVA) mode. The liquid crystal display device includes a first substrate 21, a second substrate 22 disposed opposite to the first substrate 21, and a liquid crystal layer 23 located between the first substrate 21 and the second substrate 22. Specifically, the first substrate 21 is, for example, a color filter substrate, and the second substrate 22 is, for example, a thin film transistor array substrate.

The first substrate 21 is provided with a color resist layer 212, a black matrix 213, an overcoat layer 214, and an auxiliary electrode 215 on the side facing the liquid crystal layer 23. In this embodiment, the color resist layer 212 and the black matrix 213 are staggered and formed on the surface of the first substrate 21 facing the liquid crystal layer 23. The color resist layer 212 includes, for example, three color resist materials of red (R), green (G), and blue (B). The overcoat layer 214 covers the color resist layer 212 and the black matrix 213. The auxiliary electrode 215 is formed on the overcoat layer 214, and the auxiliary electrode 215 may be a whole surface structure or a patterned structure.

The second substrate 22 is provided with scan lines 222, data lines 223, thin film transistors (TFT) 224, a common electrode 225, an insulating layer 226, and pixel electrodes 227 on the side facing the liquid crystal layer 23. A plurality of scan lines 222 and a plurality of data lines 223 are crossed each other to define a plurality of pixel units P. Each pixel unit P is provided with a pixel electrode 227, which is connected to a corresponding scan line 222 and a corresponding data line 223 through a thin film transistor 224. The common electrode 225 and the pixel electrodes 227 are spaced apart and insulated from each other by the insulating layer 226, and the pixel electrodes 227 may be located above or below the common electrode 225. In this embodiment, the pixel electrodes 227 are located above the common electrode 225, the common electrode 225 is a whole surface structure, and each pixel electrode 227 has a comb-shaped structure, so that the liquid crystal display device is formed into a fringe field switching (FFS) mode to obtain a wide viewing angle in normal display.

In other embodiments, the common electrode 225 and the pixel electrodes 227 may be located in the same layer and insulated from each other. In this embodiment, the insulating layer 226 may be omitted. The pixel electrode 227 has a comb-shaped structure, and the common electrode 225 is formed into a comb-shaped structure at a position corresponding to each pixel electrode 227 in order to mutually insert with each other, so that the liquid crystal display device is formed into an in-plane switching (IPS) mode, which can also obtain a wide viewing angle during normal display.

It should be understood that in this embodiment, only the film layers related to the present invention are illustrated on the first substrate 21 and the second substrate 22, and the unrelated film layers are omitted.

In this embodiment, the liquid crystal layer 23 adopts positive liquid crystal molecules, that is, the liquid crystal molecules with positive dielectric anisotropy. In the initial state (i.e., no voltage is applied to the liquid crystal display device), the positive liquid crystal molecules in the liquid crystal layer 23 assume a lying posture which is substantially parallel to the first substrate 21 and the second substrate 22, and the length direction of the positive liquid crystal molecules is substantially parallel to the surface of the first substrate 21 and the second substrate 22 (as shown in FIG. 4). In practical applications, the positive liquid crystal molecules within the liquid crystal layer 23 may have small initial pretilt angle relative to the first substrate 21 and the second substrate 22, and a range of the initial pretilt angle may be less than or equal to 10 degrees, i.e., $0° \leq \theta \leq 10°$.

Referring to FIGS. 4 and 5, by applying different voltages on the auxiliary electrode 215 and the common electrode 225, the liquid crystal display device can be controlled to switch between a wide viewing angle mode and a narrow viewing angle mode.

For example, when a DC reference voltage Vref is applied to the common electrode 225, and the voltage applied to the auxiliary electrode 215 is same or similar as the common electrode 225, the voltage difference between the auxiliary electrode 215 and the common electrode 225 is less than a preset value (e.g., less than 1V), the tilt angle of the liquid crystal molecules in the liquid crystal layer 23 nearly does not change and the liquid crystal molecules remain in a substantially lying posture, so the liquid crystal display device is in a normal wide viewing angle mode (as shown in FIG. 4). When a DC reference voltage Vref is applied to the common electrode 225 and an AC voltage Vac fluctuated up and down around the DC reference voltage Vref is applied to the auxiliary electrode 215, the voltage difference between the auxiliary electrode 215 and the common electrode 225 is greater than a preset value (e.g., greater than 3V), a strong vertical electric field E will be generated between the first substrate 21 and the second substrate 22 in the liquid crystal cell, causing the liquid crystal molecules to deflect, and the tilt angle of the liquid crystal molecules relative to the first substrate 21 and the second substrate 22 increases and the liquid crystal molecules are tilted and changed from the lying posture to a tilted posture, causing the liquid crystal display device to occur light leakage at large observation angles, such that the liquid crystal display device finally enters a narrow viewing angle mode (as shown in FIG. 5).

Alternatively, when a DC reference voltage Vref is applied to the auxiliary electrode 215, and the voltage applied to the common electrode 225 is same or similar as the auxiliary electrode 215, the voltage difference between the common electrode 225 and the auxiliary electrode 215 is less than a preset value (e.g., less than 1V), the tilt angle of the liquid crystal molecules in the liquid crystal layer 23 nearly does not change and the liquid crystal molecules remain in a substantially lying posture, so the liquid crystal display device is in a normal wide viewing angle mode (as shown in FIG. 4). When a DC reference voltage Vref is applied to the auxiliary electrode 215 and an AC voltage Vac fluctuated up and down around the DC reference voltage Vref is applied to the common electrode 225, the voltage difference between the common electrode 225 and the auxiliary electrode 215 is greater than a preset value (e.g., greater than 3V), a strong vertical electric field E will be generated between the first substrate 21 and the second substrate 22 in the liquid crystal cell, and the liquid crystal molecules will tilt under the action of the vertical electric field E, so that the tilt angle of the liquid crystal molecules relative to the first substrate 21 and the second substrate 22 increases and the liquid crystal molecules are tilted and changed from the lying posture to a tilted posture, causing the liquid crystal display device to occur light leakage at large observation angles, such that the liquid crystal display device finally enters a narrow viewing angle mode (as shown in FIG. 5).

As shown in FIGS. 4-5, in order to apply a voltage signal to the auxiliary electrode 215 on the first substrate 21, the first substrate 21 can be conducted to the second substrate 22 through a conductive adhesive 80 in the non-display area around the liquid crystal display device, so that a driving circuit 60 provides a voltage signal to the second substrate 22, and then the second substrate 22 applies the voltage signal to the auxiliary electrode 215 of the first substrate 21 through the conductive adhesive 80.

In the wide viewing angle mode, the voltage difference between the auxiliary electrode 215 and the common electrode 225 may be in the range of from 0V to 1V. Preferably, the same voltage is applied to both the auxiliary electrode 215 and the common electrode 225, so that the voltage difference between the auxiliary electrode 215 and the common electrode 225 is zero, and a better wide viewing angle display effect can be achieved.

In the narrow viewing angle mode, the voltage difference between the auxiliary electrode 215 and the common electrode 225 may be in the range of from 3V to 7V. For example, the voltage difference between the auxiliary electrode 215 and the common electrode 225 can be selected as 4V, 5V, 6V, etc. as needed to achieve the desired narrow viewing angle display effect.

Figure 6:
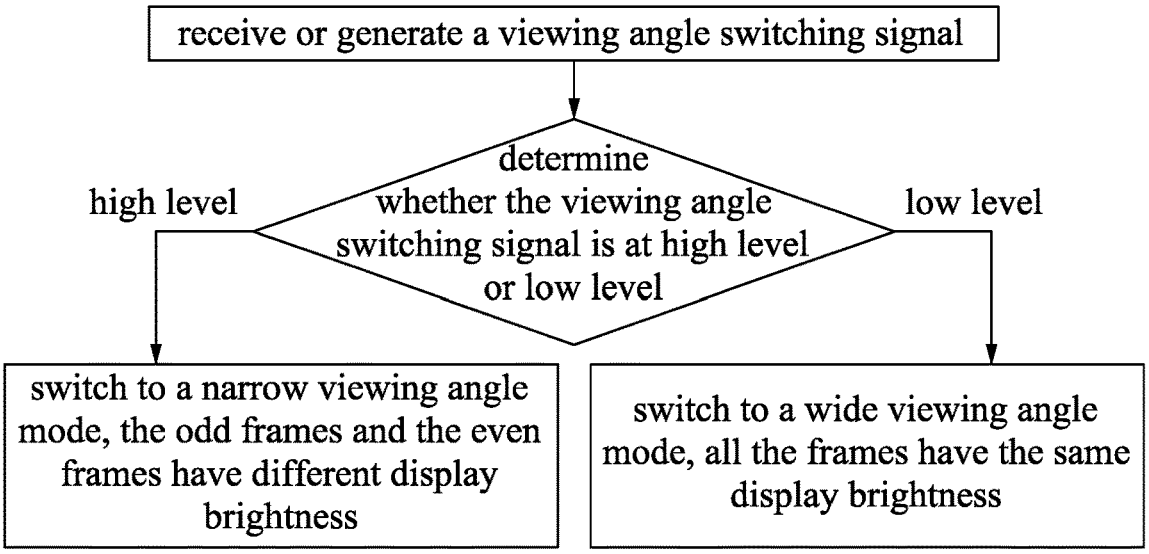
FIG. 6 is a flowchart of a driving method for the liquid crystal display device of FIG. 3.

Referring to FIG. 6, an embodiment of the present invention further provides a driving method for the liquid crystal display device. The liquid crystal display device has a wide viewing angle mode and a narrow viewing angle mode. The liquid crystal display device can determine the required viewing angle mode according to a viewing angle switching signal HVA which may be issued by the users or automatically generated by the liquid crystal display device. Specifically, the viewing angle switching signal HVA may be a voltage signal, and the liquid crystal display device may determine the required viewing angle mode according to the level of the viewing angle switching signal HVA. For example, when the viewing angle switching signal HVA is at a high level, the liquid crystal display device is switched to the narrow viewing angle mode; when the viewing angle switching signal HVA is at a low level, the liquid crystal display device is switched to the wide viewing angle mode.

As described above, when a DC reference voltage Vref is applied to one of the auxiliary electrode 215 and the common electrode 225 and a voltage that is the same as or close to the DC reference voltage Vref is applied to the other one of the auxiliary electrode 215 and the common electrode 225, the liquid crystal display device is in the wide viewing angle mode. When a DC reference voltage Vref is applied to one of the auxiliary electrode 215 and the common electrode 225 and an AC voltage Vac fluctuated up and down around the DC reference voltage Vref is applied to the other one of the auxiliary electrode 215 and the common electrode 225, the liquid crystal display device is in the narrow viewing angle mode.

Specifically, in the wide viewing angle mode, all the frames of the liquid crystal display device have the same display brightness; but in the narrow viewing angle mode, the odd frames and the even frames of the liquid crystal display device have different display brightness.

Specifically, in the narrow viewing angle mode, the odd frames and the even frames of the liquid crystal display device have different display brightness, either the display brightness of the odd frames of the liquid crystal display device is higher than that of the even frames or the display brightness of the even frames of the liquid crystal display device is higher than that of the odd frames.

In the narrow viewing angle mode, in order to make the odd frames and the even frames of the liquid crystal display device have different display brightness, it can be achieved by varying the driving voltages in the odd frames and the even frames, because the display brightness of the liquid crystal display device is related to the driving voltages Vpixel applied to the data lines 223. Specifically, a way of varying the driving voltages may be any one of the following a1-a6:

a1: in the odd frames, the driving voltages Vpixel on the data lines 223 are increased so that the odd frames become bright frames; while in the even frames, the driving voltages Vpixel on the data lines 223 are reduced so that the even frames become dark frames.

a2: in the even frames, the driving voltages Vpixel on the data lines 223 are increased so that the even frames become bright frames; while in the odd frames, the driving voltages Vpixel on the data lines 223 are reduced so that the odd frames become dark frames.

a3: in the odd frames, the driving voltages Vpixel on the data lines 223 are increased so that the odd frames become bright frames; but in the even frames, the original driving voltages Vpixel are maintained on the data lines 223 so that the even frames become dark frames.

a4: in the even frames, the driving voltages Vpixel on the data lines 223 are increased so that the even frames become bright frames; but in the odd frames, the original driving voltages Vpixel are maintained on the data lines 223 so that the odd frames become dark frames.

a5: in the odd frames, the driving voltages Vpixel on the data lines 223 are reduced so that the odd frames become dark frames; but in the even frames, the original driving voltages Vpixel are maintained on the data lines 223 so that the even frames become bright frames.

a6: in the even frames, the driving voltages Vpixel on the data lines 223 are reduced so that the even frames become dark frames; but in the odd frames, the original driving voltages Vpixel are maintained on the data lines 223 so that the odd frames become bright frames.

Figure 7:
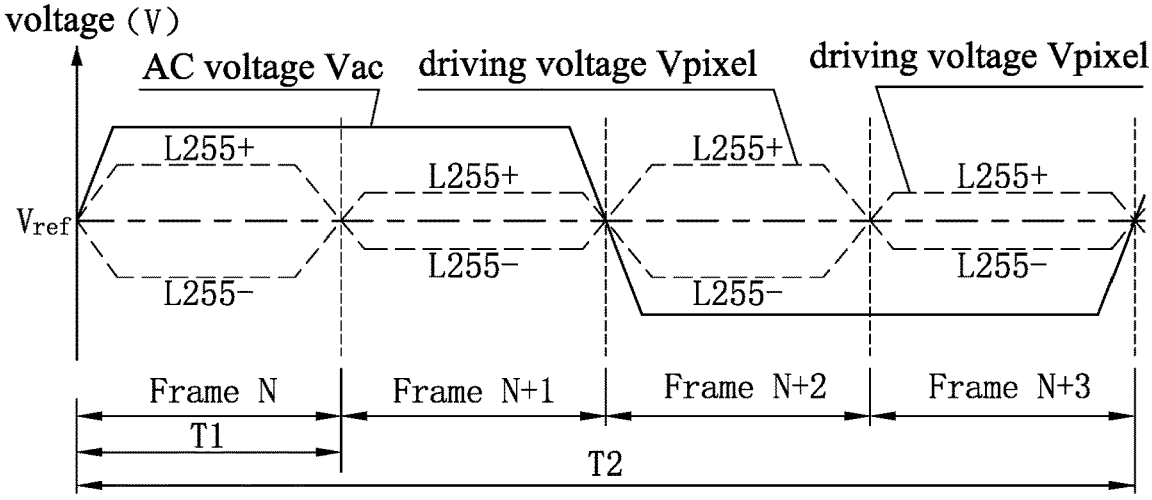
FIG. 7 is a schematic diagram of one driving waveform of the liquid crystal display device of FIG. 3 in the narrow viewing angle mode.

FIG. 7 is a schematic diagram depicting one kind of driving waveform of the liquid crystal display device when displaying a L255 gray-scale static image. Referring to FIG. 7, in the narrow viewing angle mode, it is assumed that the image refresh rate (i.e., frame rate) of the liquid crystal display device is 120 frames per second, wherein high driving voltages are applied to the data lines 223 in the sixty odd frames which are correspondingly displayed as high brightness, while low driving voltages are applied to the data lines 223 in the sixty even frames which are correspondingly displayed as low brightness. That is, when the same gray scale (e.g., L255 gray scale) is displayed, the driving voltages applied to the data lines 223 in the odd frames are higher than the driving voltages applied to the data lines 223 in the even frames, so that the brightness of the odd frames is greater than the brightness of the even frames. As shown in FIG. 7, Frame N and Frame N+2 are bright frames, while Frame N+1 and Frame N+3 are dark frames.

FIG. 7 only takes the display of L255 gray scale as an example, but in fact, the driving voltages of the bright frames and dark frames corresponding to different gray scales can be defined according to two sets of different gray scale-voltage curves (L-V curves). That is, in the narrow viewing angle mode, the liquid crystal display device can be driven by two sets of gamma voltages with different voltage values, one set of gamma voltages (e.g., Gamma1) is used when displaying the odd frames, and another set of gamma voltages (e.g., Gamma2) is used when displaying the even frames. When the voltage value of Gamma1 is greater than the voltage value of Gamma2, the odd frames can be bright frames and the even frames can be dark frames. When the voltage value of Gamma1 is less than the voltage value of Gamma2, the odd frames can be dark frames and the even frames can be bright frames.

Specifically, a resistor string or a gamma chip may be used to generate different sets of required gamma voltages, namely the above-mentioned Gamma1 and Gamma2.

As shown in FIG. 7, in the narrow viewing angle mode, the AC voltage Vac applied to the auxiliary electrode 215 or the common electrode 225 may change its polarity once every two frames. At this time, the period T2 of the AC voltage Vac is four times the display time T1 of each frame of the liquid crystal display device.

Figure 8:
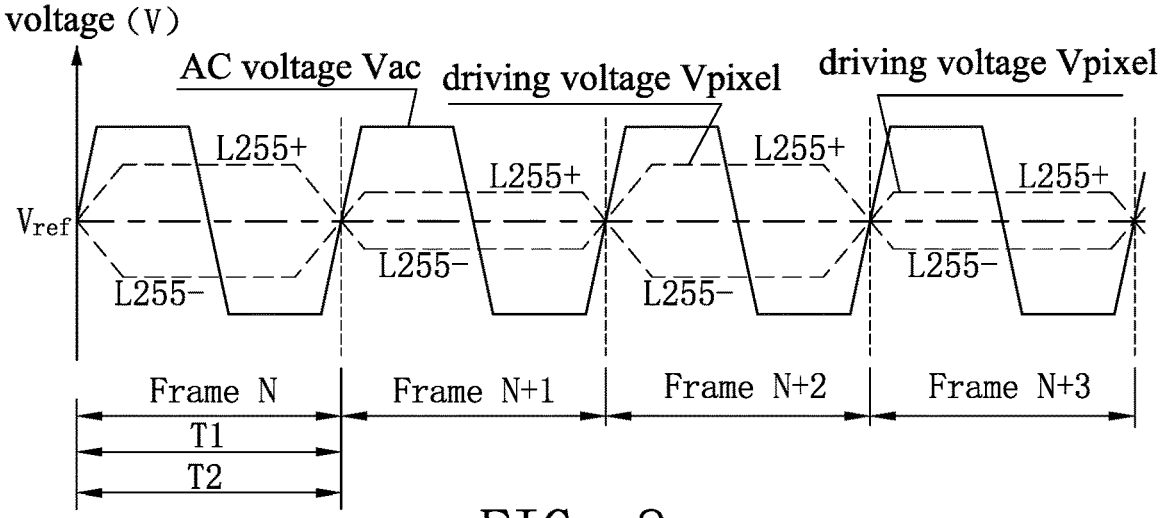
FIG. 8 is a schematic diagram of another driving waveform of the liquid crystal display device of FIG. 3 in the narrow viewing angle mode.

As shown in FIG. 8, in the narrow viewing angle mode, the AC voltage Vac applied to the auxiliary electrode 215 or the common electrode 225 may also change its polarity twice per frame. At this time, the period T2 of the AC voltage Vac is equal to the display time T1 of each frame of the liquid crystal display device.

Figure 9A:
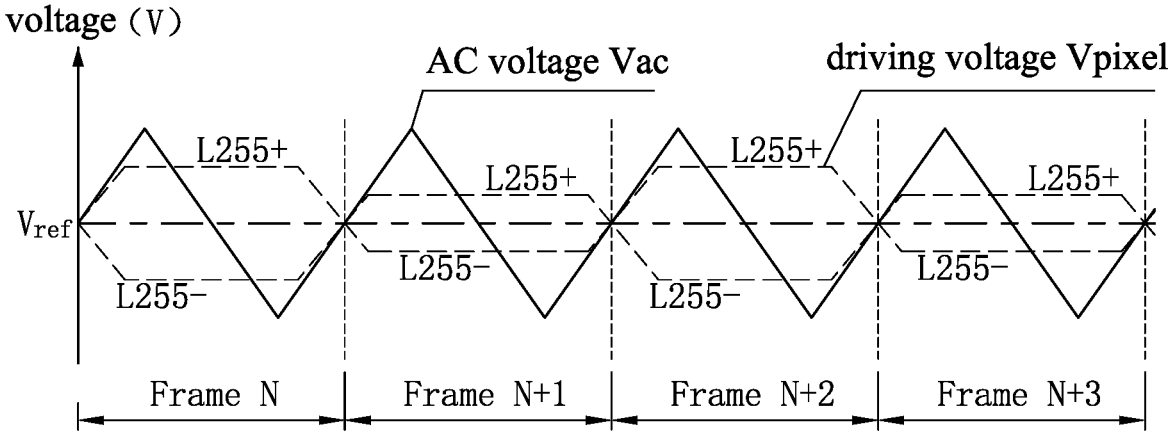
FIGS. 9*a* and 9*b* are schematic diagrams of other driving waveforms of the liquid crystal display device of FIG. 3 in the narrow viewing angle mode.
Figure 9B:
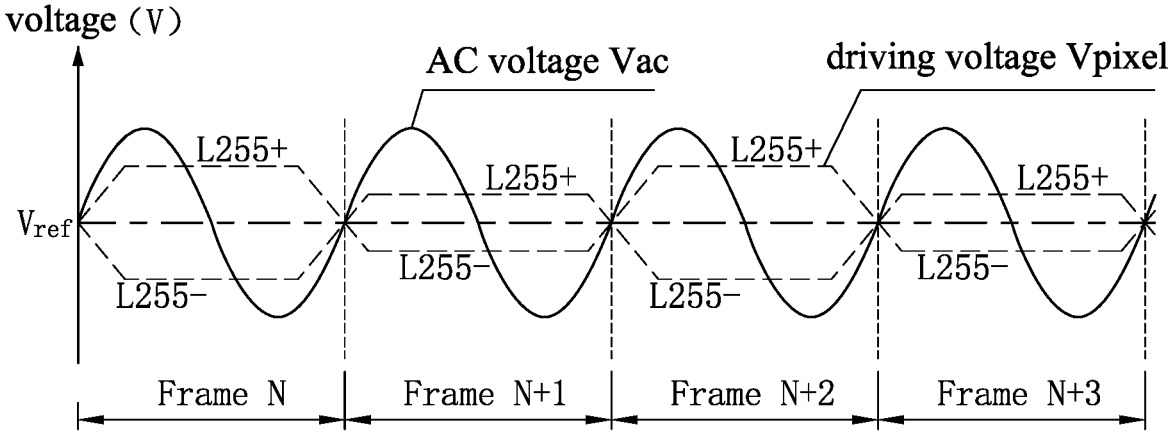

In FIGS. 7 and 8, it is shown that the waveform of the AC voltage Vac is a square wave. Unlike FIG. 8, FIGS. 9*a* and 9*b* show that the waveform of the AC voltage Vac is a triangular wave or a sine wave.

Figure 10:
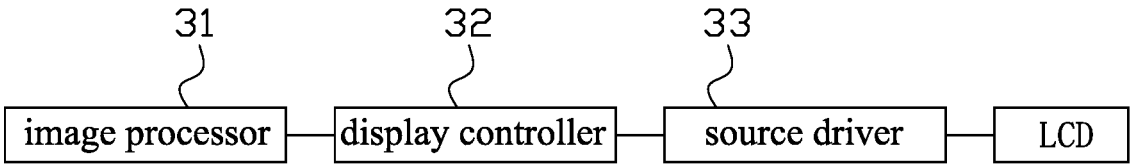
FIG. 10 is a block diagram showing a module structure of the liquid crystal display device of FIG. 3.

Optionally, in the narrow viewing angle mode, in order to make the odd frames and the even frames of the liquid crystal display device have different display brightness, it can also be realized by processing the image data (i.e., the data to be displayed). Referring to FIG. 10, the liquid crystal display device further includes an image processor 31, a display controller 32, and a source driver 33. The image processor 31 can be used to add or subtract the image data, and the processed image data is transmitted to the source driver 33 by the display controller 32, and then transmitted to the liquid crystal display device (LCD) by the source driver 33 through each data line 223 for display.

For example, assuming that the original display gray level corresponding to the image data is Ln (Ln is any gray level from L0 to L255), when the image data is subjected to an adding process, the display gray level corresponding to the image data may be L(n+1), which is equivalent to increasing its display gray level to improve the display brightness; when the image data is subjected to a subtracting process, the display gray level corresponding to the image data may be L(n−1), which is equivalent to reducing its display gray scale to reduce the display brightness. That is, adding the image data values can increase the display brightness, and subtracting the image data values can reduce the display brightness. Thus, the ways of processing the image data can be any one of the following b1-b6:

b1: the image data values of the odd frames are added so that the odd frames become bright frames; the image data values of the even frames are subtracted so that the even frames become dark frames.

b2: the image data values of the even frames are added so that the even frames become bright frames; the image data values of the odd frames are subtracted so that the odd frames become dark frames.

b3: the image data values of the odd frames are subtracted so that the odd frames become bright frames; but the image data values of the even frames are unchanged so that the even frames become dark frames.

b4: the image data values of the even frames are added so that the even frames become bright frames; but the image data values of the odd frames are unchanged so that the odd frames become dark frames.

b5: the image data values of the odd frames are subtracted so that the odd frames become dark frames; but the image data values of the even frames are unchanged so that the even frames become bright frames.

b6: the image data values of the even frames are subtracted so that the even frames become dark frames; but the image data values of the odd frames are unchanged so that the odd frames become bright frames.

Figure 11A:
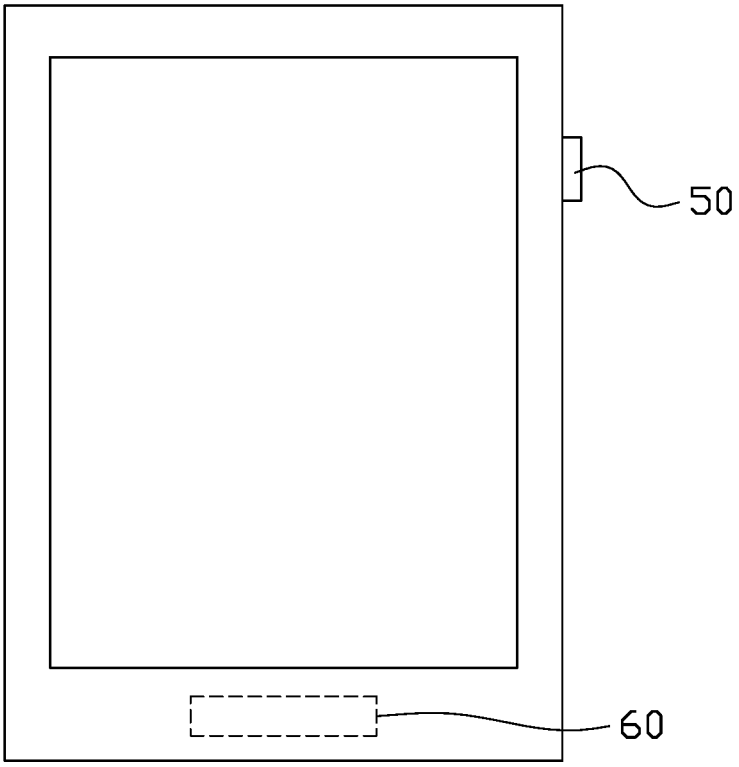
FIGS. 11*a* and 11*b* are schematic plan views showing the planar structure of the liquid crystal display device of FIG. 3 in one example.
Figure 11B:
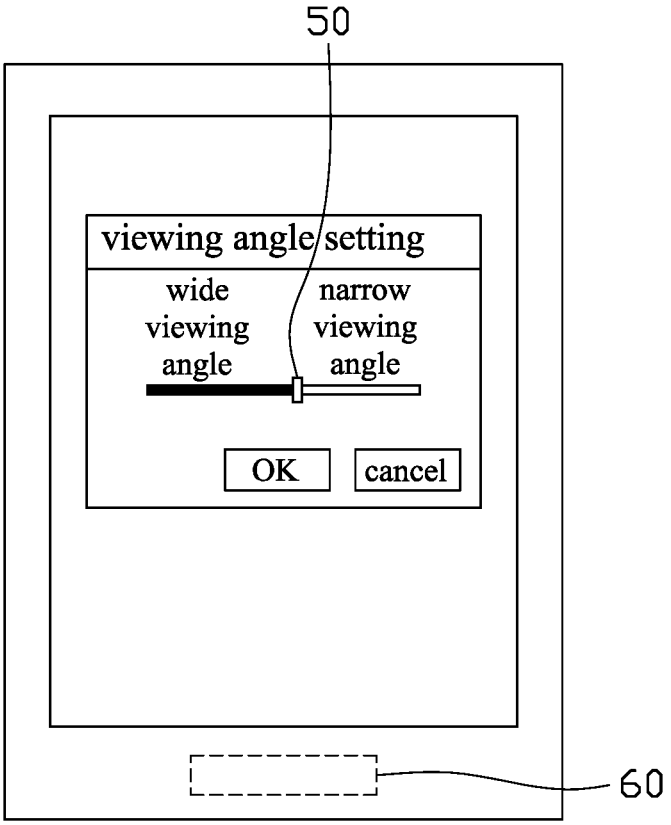

Referring to FIG. 11*a* to FIG. 11*b*, the liquid crystal display device may be provided with a viewing angle switching button 50 for switching different viewing angle modes of the liquid crystal display device. The viewing angle switching button 50 may be a mechanical button (as shown in FIG. 11*a*) or a virtual button (as shown in FIG. 11*b*, set through a window). When a user needs to switch between the wide and narrow viewing angle modes, a viewing angle switching signal HVA can be sent to the liquid crystal display device by operating the viewing angle switching button 50, and finally the driving circuit 60 controls the voltages applied to the auxiliary electrode 215 and the common electrode 225 to achieve the switching between the wide and narrow viewing angle modes. Therefore, by operating the viewing angle switching button 50, the user can switch between the wide viewing angle mode and the narrow viewing angle mode easily with good operation flexibility and convenience.

Figure 12:
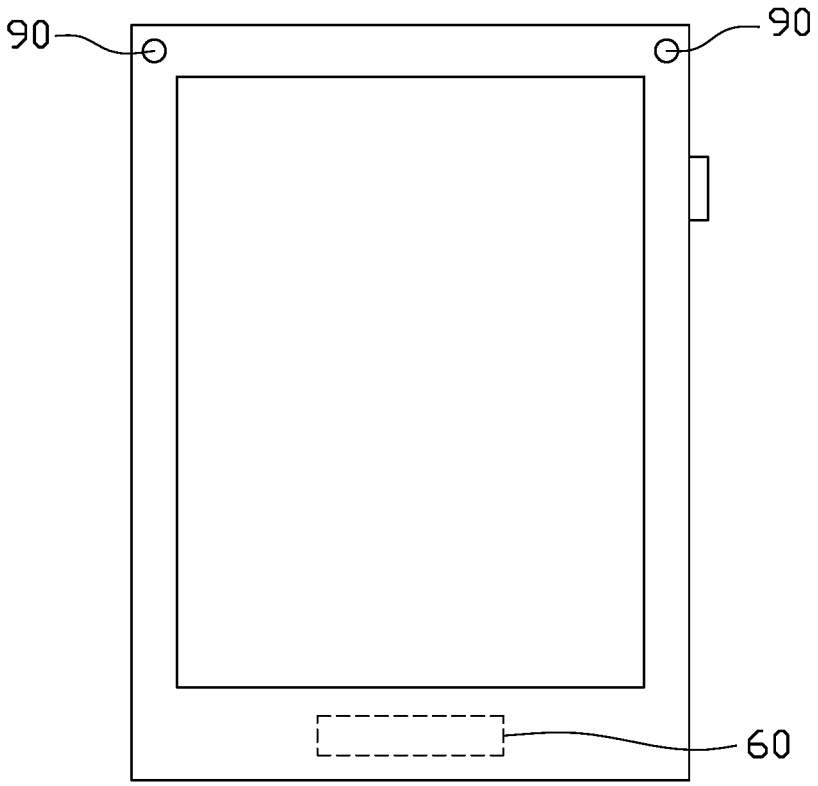
FIG. 12 is a schematic plan view showing the planar structure of the liquid crystal display device of FIG. 3 in another example.

Referring to FIG. 12, in another embodiment, the liquid crystal display device may be provided with a detection sensor 90, and the detection sensor 90 is used to detect whether there is a person near the liquid crystal display device. The number of the detection sensor 90 may be multiple, distributed on the outer casing of the liquid crystal display device. The detection sensor 90 may be an infrared sensor. The controller of the liquid crystal display device can control the liquid crystal display device to switch between the wide and narrow viewing angle modes automatically, according to a detection result of the detection sensor 90. For example, when the detection sensor 90 detects that somebody is near the liquid crystal display device, the liquid crystal display device is controlled to switch to the narrow viewing angle mode automatically; when the detection sensor 90 detects that nobody is near the liquid crystal display device, the liquid crystal display device is controlled to switch to the wide viewing angle mode automatically. Therefore, by providing the detection sensor 90, the wide and narrow viewing angle modes can be switched automatically, without requiring the user to switch the wide and narrow viewing angle modes manually, thereby further improving the user experience.

In other embodiments, the liquid crystal display device can also be controlled to switch between wide and narrow viewing angle modes automatically, according to the user's usage scenarios. For example, when it is detected that the user is using an e-mail or inputting a password, and other usage scenarios that require anti-peeping, the liquid crystal display device is controlled to switch to the narrow viewing angle mode automatically; when the user is not in these usage scenarios that require anti-peeping, the liquid crystal display device is controlled to switch to the wide viewing angle mode automatically.

The embodiments of the present invention provide driving methods of a liquid crystal display device, in the narrow viewing angle mode, by alternately driving bright and dark frames, the display quality of the images in the bias mode is better than that of the original images, and the degree of mura is obviously reduced, to improve the large observation angle mura problem of the existing liquid crystal display device in the bias mode and improve the smoothness of the dynamic picture display, thereby improving the user experience.

The liquid crystal display device provided by the embodiments of the present invention can easily switch between the wide viewing angle mode and the narrow viewing angle mode under different occasions, has good operation flexibility and convenience, to achieve a multifunctional liquid crystal display device integrated with the functions of entertainment and privacy protection.

The above are only the preferred embodiments of the present invention and are not intended to limit the present invention. Any modification, equivalent replacement, improvement, etc. within the spirit and principle of the present invention should be included in the protection scope of the present invention.

What is claimed is:

1. A driving method for a liquid crystal display device having a wide viewing angle mode and a narrow viewing angle mode, wherein the liquid crystal display device comprises a first substrate, a second substrate disposed opposite to the first substrate, and a liquid crystal layer located between the first substrate and the second substrate, an auxiliary electrode is provided on the first substrate, a common electrode and pixel electrodes are provided on the second substrate; wherein the driving method comprises:

when a DC reference voltage is applied to one of the common electrode and the auxiliary electrode, and the voltage applied to the other one of the common electrode and the auxiliary electrode is same or similar as the common electrode, the voltage difference between the common electrode and the auxiliary electrode is less than a preset value, the liquid crystal display device is in the wide viewing angle mode; and in the wide viewing angle mode, when displaying static images, all frames of the liquid crystal display device have the same display brightness;

when a DC reference voltage is applied to one of the common electrode and the auxiliary electrode, and an AC voltage fluctuated up and down around the DC reference voltage is applied to the other one of the common electrode and the auxiliary electrode, the voltage difference between the common electrode and the auxiliary electrode is greater than a preset value, the liquid crystal display device is in the narrow viewing angle mode; and in the narrow viewing angle mode, odd frames and even frames of the liquid crystal display device have different display brightness.

2. The driving method according to claim 1, wherein in the narrow viewing angle mode, the display brightness of the odd frames of the liquid crystal display device is higher than that of the even frames, or the display brightness of the even frames of the liquid crystal display device is higher than that of the odd frames.

3. The driving method according to claim 2, wherein in the narrow viewing angle mode, the liquid crystal display device adopts a way of varying the driving voltages to realize that the odd frames and the even frames have different display brightness.

4. The driving method according to claim 3, wherein in the narrow viewing angle mode, the liquid crystal display device is driven with two sets of gamma voltages of different voltage values, one set of gamma voltages is used when the odd frames are displayed, and the other set of gamma voltages is used when the even frames are displayed.

5. The driving method according to claim 2, wherein in the narrow viewing angle mode, the liquid crystal display device adopts a way of processing image data to realize that the odd frames and the even frames have different display brightness.

6. The driving method according to claim 5, wherein the liquid crystal display device comprises an image processor, the image processor is used to add or subtract the image data, and the processed image data is then transmitted to the liquid crystal display device for display.

7. The driving method according to claim 1, wherein the AC voltage changes its polarity once every two frames, and the period of the AC voltage is four times the display time of each frame of the liquid crystal display device.

8. The driving method according to claim 1, wherein the AC voltage changes its polarity twice per frame, and the period of the AC voltage is equal to the display time of each frame of the liquid crystal display device.

9. The driving method according to claim 1, wherein in the narrow viewing angle mode, the image refresh rate of the liquid crystal display device is 120 frames per second.

10. The driving method according to claim 1, wherein the liquid crystal display device is provided with a viewing angle switching button configured for users to switch different viewing angle modes of the liquid crystal display device.

11. The driving method according to claim 1, wherein the liquid crystal display device detects by a detection sensor whether there is a person near the liquid crystal display device, and the liquid crystal display device is controlled to automatically switch between different viewing angle modes according to the detection result.

12. The driving method according to claim 1, wherein the liquid crystal display device detects the usage scenarios of users, and the liquid crystal display device is controlled to automatically switch between different viewing angle modes according to the detection result.

* * * * *